US007624485B2

(12) United States Patent
Crandlemire

(10) Patent No.: US 7,624,485 B2
(45) Date of Patent: Dec. 1, 2009

(54) CREMATED REMAINS SPREADING DEVICE

(76) Inventor: Scotty H. Crandlemire, 3810 Park Creek Dr., Meridian, ID (US) 83642

( * ) Notice: Subject to any disclaimer, the term of this patent is extended or adjusted under 35 U.S.C. 154(b) by 0 days.

(21) Appl. No.: 12/208,063

(22) Filed: Sep. 10, 2008

(65) Prior Publication Data

US 2009/0229096 A1 Sep. 17, 2009

Related U.S. Application Data

(60) Provisional application No. 61/011,621, filed on Mar. 11, 2008.

(51) Int. Cl.
*A61G 17/00* (2006.01)

(52) U.S. Cl. ..... 27/1; 222/637

(58) Field of Classification Search ..... 27/1; 110/194; 15/405; 221/282, 185, 258, 278; 222/394, 510, 175, 173, 637, 630; 239/650
See application file for complete search history.

(56) References Cited

U.S. PATENT DOCUMENTS 4,201,347 A 5/1980 Elkin ..... 241/92
4,473,012 A * 9/1984 Duran ..... 110/194
4,877,203 A * 10/1989 Harden ..... 244/136
4,955,548 A 9/1990 Rahill ..... 241/30
5,005,784 A * 4/1991 Harden ..... 244/136
5,743,195 A 4/1998 Sucharski ..... 110/194
6,615,463 B1 9/2003 Hojaji ..... 27/1
6,785,939 B1 9/2004 James ..... 27/1
6,892,909 B1 * 5/2005 Hebert et al. ..... 222/637
2008/0083102 A1 4/2008 Johnson ..... 27/1

* cited by examiner

*Primary Examiner*—William L. Miller
(74) *Attorney, Agent, or Firm*—Holland Law Office PLLC

(57) ABSTRACT

The present invention is directed to a cremated remains spreading device that includes a hopper for holding the cremated remains having a conduit attached to the hopper. A blower assembly including a blower and motor is connected to a first end of the conduit for providing a pressurized air flow through the conduit. The hopper is adapted to deposit the cremated remains into the pressurized air flow in the conduit, the cremated remains being discharged from an outlet port formed at a second end of the conduit.

15 Claims, 3 Drawing Sheets

CREMATED REMAINS SPREADING DEVICE

RELATED APPLICATIONS

This application claims the priority of Provisional Application Ser. No. 61/011,621 entitled Human and Animal Cremated Ashes Automated Spreading Device, filed Mar. 11, 2008, the content of said application being incorporated herein by reference.

FIELD OF THE INVENTION

This invention relates generally to devices and methods for treating human and animal remains and more particularly to a cremated remains spreading device.

BACKGROUND OF THE INVENTION

There appears to be an increased acceptance of cremation as a means for treating human and other animal remains. There exists any of a number of ways for dealing with the ashes produced by such cremation of human or other animal remains. In some instance the cremated remains may be interred or placed in a columbarium, a place for the respectful storage of urns that hold a deceased's cremated remains. Alternately, the cremated remains may be returned to family or other loved ones for scattering or other forms of disposition.

Published U.S. Patent Application 20080083102 by Johnson entitled Structure and Method for Connecting Cremation Ashes With Living Plants discloses a device for connecting cremation ashes with a living plant that includes a vessel for holding the cremated remains and a memorial structure connected to the plant positioned in a cavity of the plant. The structure is meant to create a living memorial for the deceased.

U.S. Pat. No. 6,615,463 to Hojaji entitled Methods to Solidify Cremation Ash discloses converting residual bones and ashes from the cremation process of deceased humans and animals into solid objects containing glass, ceramics, clay based materials, or composites such as materials.

U.S. Pat. No. 5,743,195 to Sucharski entitled Apparatus for the Ventilation, Filtration and Collection of Cremated Remains Dust Produced During Processing discloses an apparatus for comminuting cremation remains hat includes a stand having a support for the comminuting apparatus and built in vents which communicate with a blower motor to draw in all of the resulting dust and other contaminants resulting from this process. A series of filters are placed in communication with the vents to trap all pollutants.

U.S. Pat. No. 4,955,548 to Rahill entitled Method and Apparatus for Comminuting Cremation Remains discloses a processing drum having a rotatable comminuting blade driven by a shaft extending into the drum. An ashpan is rotatably positioned so as to move into and out of engagement with the drum for charging the drum with cremation remains for further handling.

U.S. Pat. No. 4,201,347 to Elkin entitled Crematory Ash Grinder discloses a mechanism for crushing and grinding cremated remains the ground cremation remains falling through apertures in the grinding disk into a funnel for collection in an urn positioned below the grinder.

It has been observed that when a family member or other loved one is charged with scattering or disposition of the cremated remains, the handling of the cremated remains, in some instances, may prove to be an uncomfortable experience. Even so there appears to be no reliable solution to assist individuals in performing this solemn and often emotional duty.

While any number of devices have been developed that are directed to various aspects of cremation and the treatment of cremated remains, still there is a need for a device that would assist a family member or other individual charged with scattering of the cremated remains. Therefore an object of the present invention is to provide a device for scattering cremated human or other animal remains.

SUMMARY OF THE INVENTION

The present invention relates to a cremated remains spreading device including a hopper for holding the cremated remains and a conduit connected near a first end to a conduit that selectively communicates with the conduit. The first end of the conduit is connected to a blower assembly while the second end forms a port from which the cremated remains may be discharged. In the preferred embodiment, a valve is disposed between the hopper and the conduit for selectively connecting the conduit to the hopper for passage of the cremated remains into a pressurized air flow provided by the blower assembly. The blower assembly includes a motor connected to a blower which in turn is connected to the conduit to provide pressurized air through the conduit.

The device for scattering cremated remains may also include a valve actuator, which in the preferred embodiment is configured as a push/pull actuator rod operatively connected to the valve. Also in the preferred embodiment, a micro-switch is operatively connected to the actuator rod so that when the actuator rod is pulled, the micro-switch operates to start the motor. Conversely, when the actuator rod is pushed, the micro-switch operates to terminate operation of the motor. The preferred embodiment of the device also includes a battery, preferably rechargeable, conductively connected to the motor and the micro-switch. The device for scattering cremated remains is preferably mounted within a decorative enclosure that may be made of various materials including wood, pressboard, metal, plastic, plywood with wood veneer, fiberglass, or composite, and which may be configured having any of a wide variety of outward appearances.

The foregoing has outlined rather broadly the features and technical advantages of the present invention so that the detailed description of the invention that follows may be better understood. Additional features and advantages of the invention will be described hereinafter, which form the subject of the invention. It should be appreciated by those skilled in the art that the conception and the specific embodiments disclosed might be readily used as a basis for modification or design of devices for carrying out the same purposes of the present invention. It should also be realized by those skilled in the art that such equivalent constructions do not depart from the spirit and scope of the invention as set forth herein.

BRIEF DESCRIPTION OF THE FIGURES

The accompanying figures which are incorporated in and form a part of the specification, illustrate embodiments of the present invention, and, together with the description, serve to explain the principles of the invention.

It is to be noted that the figures illustrate a typical embodiment of the invention and are therefore not to be considered limiting of its scope, for the invention will admit to other equally effective embodiments.

DETAILED DESCRIPTION OF THE INVENTION

Figure 1:
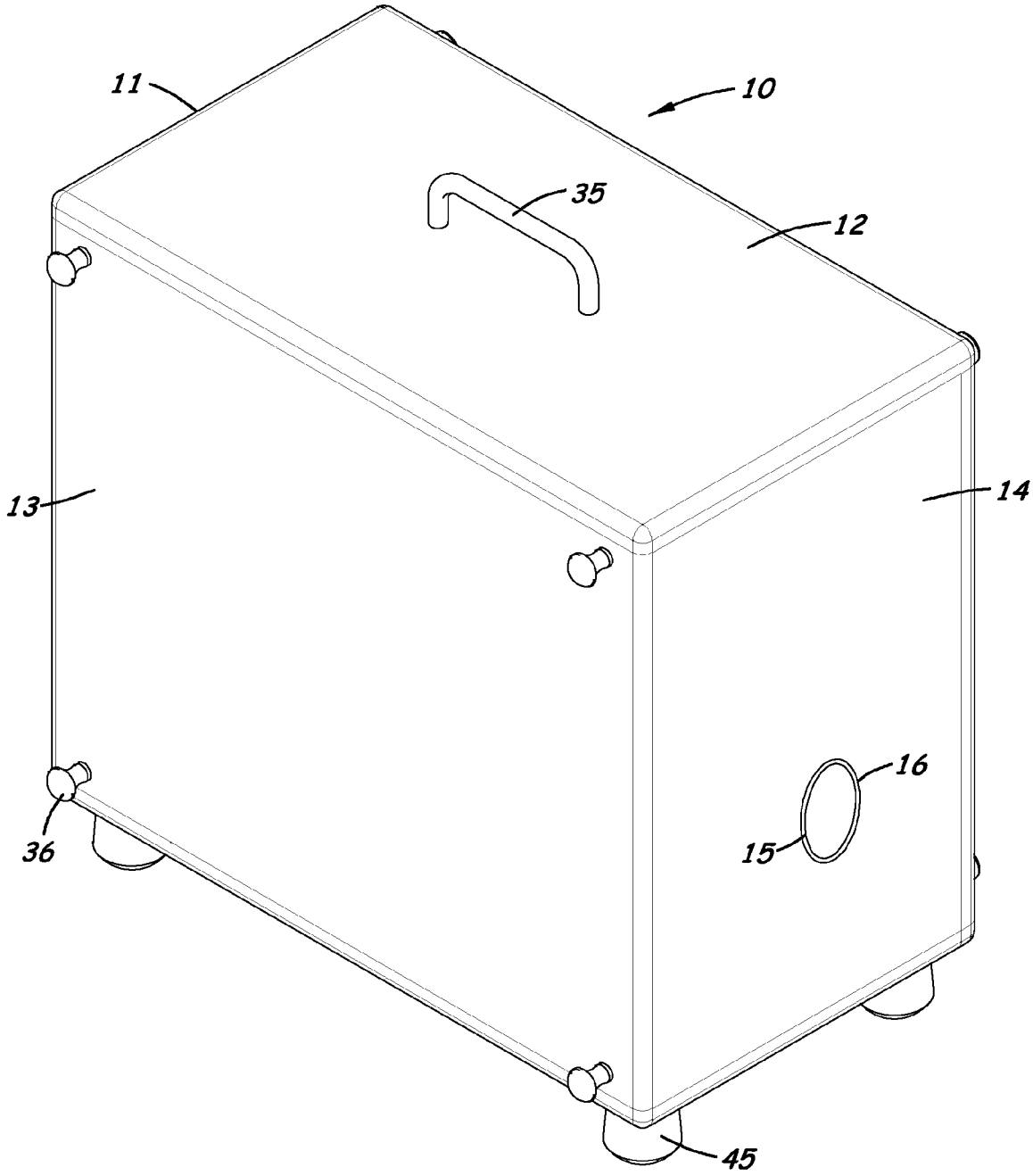
FIG. 1 is a representative isometric of a device for scattering cremated remains according to the present invention.

FIG. 1 shows cremated remains spreading device 10 fully including enclosure 11 having top panel 12, first side panel 13 and end panel 14. Outlet port 15 is shown projecting partially through aperture 16 formed in first end panel 14. Top panel 12 is removable using handle 35. First side panel 13 is secured to enclosure 11 employing a plurality of threaded knobs typified by threaded knob 36. Enclosure 11 sits atop and is secured to dampening feet 45.

Figure 2:
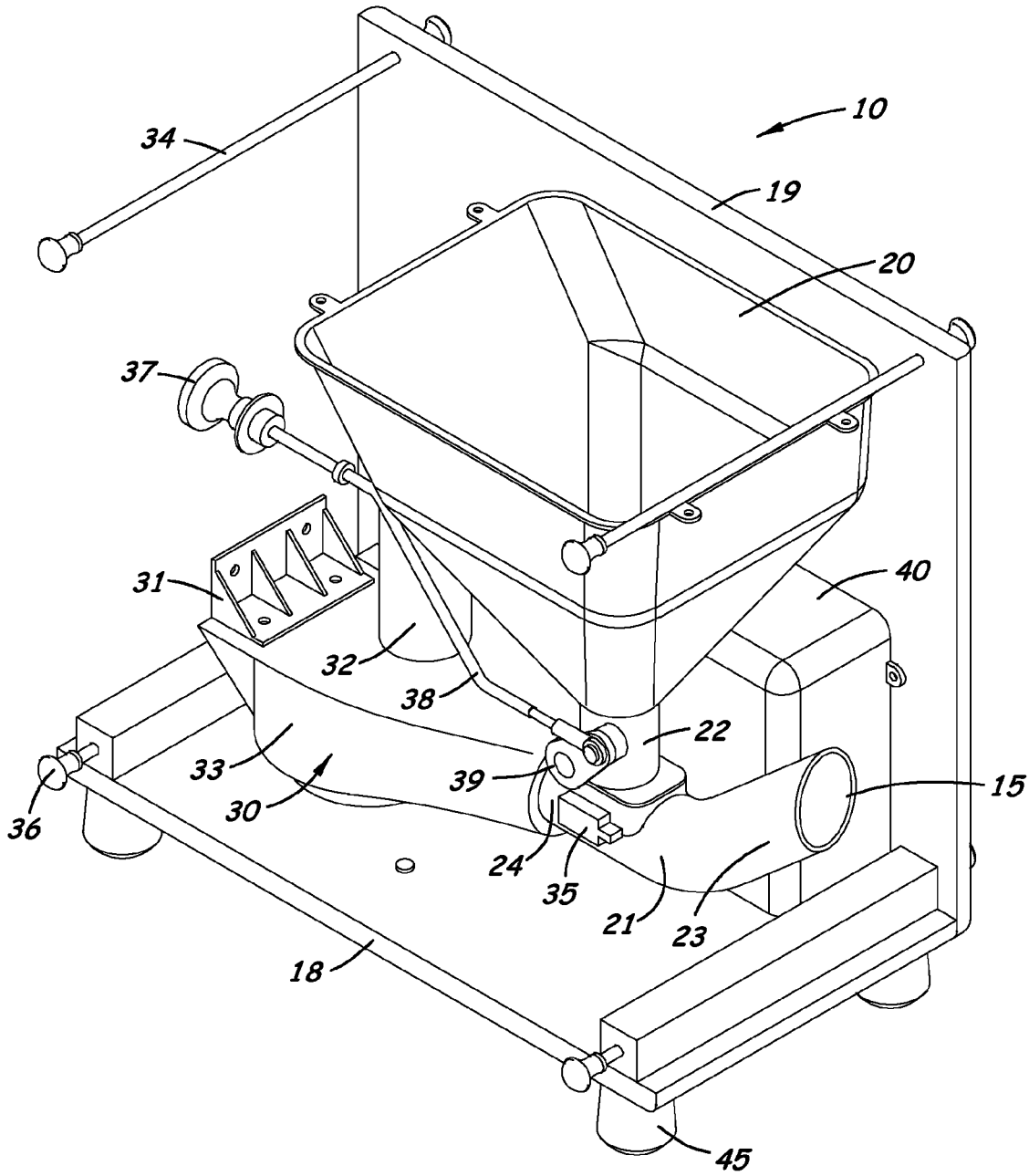
FIG. 2 is a representative isometric of a device for scattering cremated remains according to the present invention.

FIG. 2 is a side view of cremated remains spreading device 10 with top panel 12, first side panel 13, first end panel 14, (shown in FIG. 1), and second end panel 17, (shown in FIG. 3), removed to display the contents of enclosure 11. Second side panel 19 is shown connected to bottom panel 18. A plurality of threaded rods typified by threaded rod 34 are adapted to permit threaded engagement with a plurality of threaded knobs typified by threaded knob 36 to hold first side panel 13, (shown in FIG. 1), and second side panel 19 in compressive relationship. Dampening feet 45 are shown attached to bottom panel 18.

Figure 3:
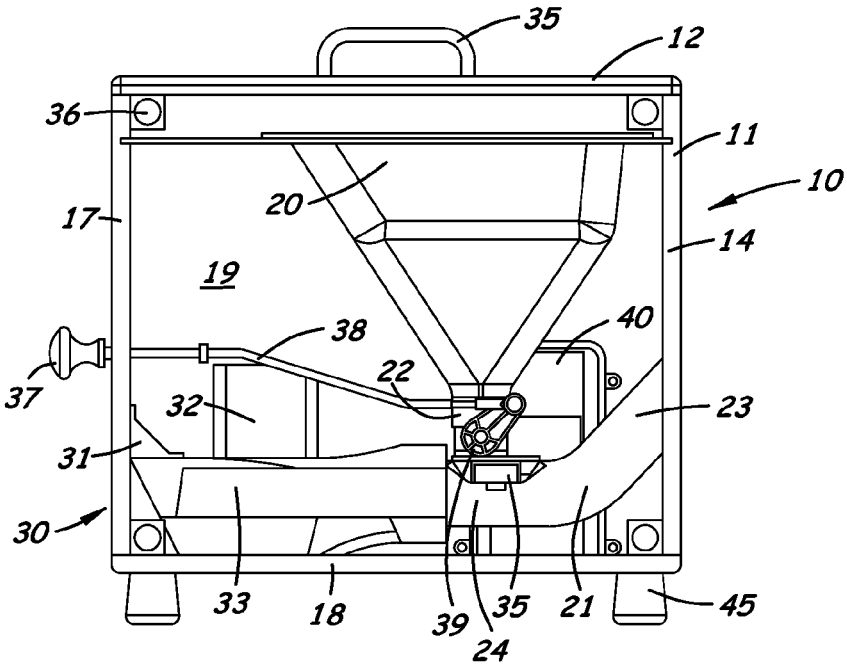
FIG. 3 is a representative side cutaway view of a device for scattering cremated remains according to the present invention.
Figure 4:
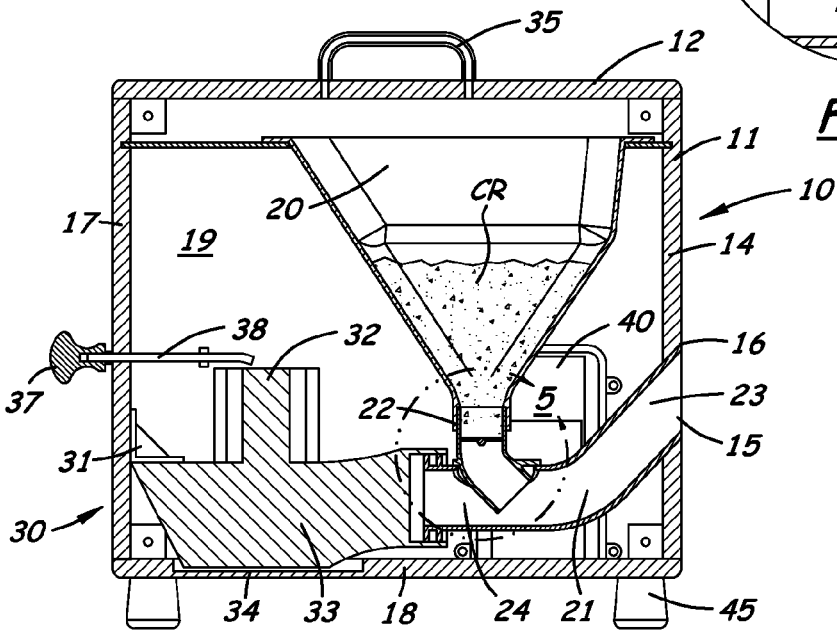
FIG. 4 is a representative side cutaway view of a device for scattering cremated remains according to the present invention.

FIGS. 3 and 4 show cremated remains spreading device 10 including first side panel 13, (shown in FIG. 1), removed to display the contents of enclosure 11. First end panel 14 and second end panel 17 are shown connected to bottom panel 18 and second side panel 19. Top panel 12 sits atop first end panel 14, second end panel 17 and second side panel 19 and is removable using handle 35 so that cremated remains, (not shown), may be placed in hopper 20. Dampening feet 45 are shown attached to bottom panel 18. FIG. 4 shows second end 23 of conduit 21 forming port 15 projecting partially through aperture 16 formed in end panel 14.

Referring to FIGS. 2-4, cremated remains spreading device 10 includes hopper 20 for holding or storing cremated remains CR, (shown in FIG. 4). Conduit 21 attaches to outlet 22 of hopper 20 while conduit second end 23 terminates at outlet port 15, (shown in FIGS. 2 and 4). In the preferred embodiment of the invention, conduit second end 23 is inclined at an upward angle so that when the cremated remains CR, (shown in FIG. 4), are discharged they assume an upward trajectory. Blower assembly 30 includes blower 33 which is driven by motor 32. Blower 33 connects to conduit 21 at conduit first end 24. Rechargeable battery 40 is connected to motor 32. Actuator rod 38 is shown having pull 37 attached at a first end.

FIGS. 3 and 4 show blower assembly including bracket 31 that attaches blower assembly 30 to end panel 17. FIG. 4 shows bottom panel 18 including intake aperture 34 adapted to permit intake of air into blower 33 during operation. FIGS. 2 and 3 show actuator rod 38 attached at a second end to butterfly actuator cam lever 39 attached at a second end. When pull 37 is activated by pulling, cam lever 39 pivots, contacting micro-switch 35, (shown in FIGS. 2 and 3), to energize motor 32 of blower assembly 30.

Figure 5:
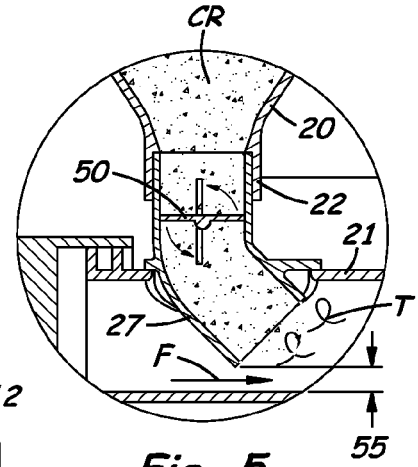
FIG. 5 is a representative detail side cutaway view of a device for scattering cremated remains according to the present invention.

FIG. 5 is a detail showing operation of butterfly valve 50 positioned within discharge tube 27 of hopper. Discharge tube 27 attaches to and extends from outlet 22 of hopper 20 inserting through a sidewall of conduit 21. Butterfly valve 50 is operable by actuator rod 38 attached to butterfly actuator cam lever 39 discussed with reference to FIGS. 3 and 4 above. As pressurized air flow F passed through conduit 21 turbulent flow T is created at constricted cross-section 55 created at the location of insertion of discharge tube 27 through the sidewall of conduit 21. Turbulent flow T assists in drawing the cremated remains CR, (shown in FIG. 5), into pressurized air flow F for discharge through conduit 21.

While the invention has been described in connection with the preferred embodiment, it is not intended to limit the scope of the invention to the particular form set forth, but, on the contrary, it is intended to cover such alternatives, modifications and equivalents as may be included within the spirit and scope of the invention as defined by the appended claims.

What is claimed is:

1. A cremated remains spreading device comprising:

an enclosure;

a hopper for holding the cremated remains;

a conduit attached to the hopper;

a blower assembly including a blower and motor, the blower pneumatically connected to a first end of the conduit, the blower providing a pressurized air flow through the conduit;

the hopper adapted to deposit the cremated remains into the pressurized air flow in the conduit, the cremated remains being discharged from an outlet port formed at a second end of the conduit; and the hopper, the conduit and the blower assembly contained within the enclosure wherein the outlet port at least partially projects through an aperture in a wall of the enclosure.

2. The cremated remains spreading device of claim 1 further comprising a valve disposed between the hopper and the conduit for selectively connecting the conduit to the hopper for passage of the cremated remains.

3. The cremated remains spreading device of claim 2 further comprising a valve actuator operatively connected to the valve for selectively operating the valve between a closed position wherein the cremated remains are retained in the hopper and an open position wherein the cremated remains are deposited from the hopper into the pressurized air flow in the conduit.

4. The cremated remains spreading device of claim 2 further comprising:

a valve actuator operatively connected to the valve for selectively operating the valve between a closed position wherein the cremated remains are retained in the hopper and an open position wherein the cremated remains are deposited from the hopper into the pressurized air flow in the conduit; and a switch conductively connected to the motor of the blower assembly, the switch positioned for selective operation by the valve actuator to energize the blower motor when the valve is positioned in the open position.

5. The cremated remains spreading device of claim 1 further comprising a battery connected to and selectively energizing the motor of the blower assembly.

6. The cremated remains spreading device of claim 1 further comprising a rechargeable battery connected to the motor of the blower assembly.

7. The cremated remains spreading device of claim 1 wherein the hopper further comprises a discharge tube inserted through a sidewall of the conduit forming a constricted cross-section in the conduit, the constricted cross-section causing a turbulence in the pressurized air flow.

8. A cremated remains spreading device comprising:

an enclosure;

a hopper for holding the cremated remains;

a conduit having a first end and a second end, the conduit first end attached to and selectively communicating with the hopper;

a valve disposed between the hopper and the conduit for selectively connecting the conduit to the hopper for passage of the cremated remains;

a blower assembly including a blower and motor connected to the conduit providing a pressurized air flow through the conduit;

the hopper adapted to deposit the cremated remains into the pressurized air flow in the conduit, the cremated remains being discharged from an outlet port formed at the second end of the conduit; and the hopper, the conduit and the blower assembly contained within the enclosure wherein the outlet port at least partially projects through an aperture in a wall of the enclosure.

9. The cremated remains spreading device of claim 8 further comprising a valve actuator operatively connected to the valve for selectively operating the valve between a closed position wherein the cremated remains are retained in the hopper and an open position wherein the cremated remains are deposited from the hopper into the pressurized air flow in the conduit.

10. The cremated remains spreading device of claim 8 further comprising:

a valve actuator operatively connected to the valve for selectively operating the valve between a closed position wherein the cremated remains are retained in the hopper and an open position wherein the cremated remains are deposited from the hopper into the pressurized air flow in the conduit; and a switch conductively connected to the motor of the blower assembly, the switch positioned for selective operation by the valve actuator to energize the blower motor when the valve is positioned in the open position.

11. The cremated remains spreading device of claim 8 further comprising a battery connected to and selectively energizing the motor of the blower assembly.

12. The cremated remains spreading device of claim 8 further comprising a rechargeable battery connected to the motor of the blower assembly.

13. The cremated remains spreading device of claim 8 wherein the hopper further comprises a discharge tube inserted through a sidewall of the conduit forming a constricted cross-section in the conduit, the constricted cross-section causing a turbulence in the pressurized air flow.

14. A cremated remains spreading device comprising:

an enclosure;

a hopper for holding the cremated remains;

a conduit having a first end and a second end, the conduit first end attached to and selectively communicating with the hopper;

a valve disposed between the hopper and the conduit for selectively connecting the conduit to the hopper for passage of the cremated remains;

a valve actuator operatively connected to the valve for selectively operating the valve between a closed position wherein the cremated remains are retained in the hopper and an open position wherein the cremated remains are deposited from the hopper into the pressurized air flow in the conduit;

a switch conductively connected to the motor of the blower assembly, the switch positioned for selective operation by the valve actuator to energize the blower motor when the valve is positioned in the open position;

a blower assembly including a blower and motor connected to the conduit providing a pressurized air flow through the conduit;

a rechargeable battery connected to the motor of the blower assembly;

the hopper adapted to deposit the cremated remains into the pressurized air flow in the conduit, the cremated remains being discharged from an outlet port formed at the second end of the conduit; and the hopper, the conduit and the blower assembly contained within the enclosure wherein the outlet port at least partially projects through an aperture in a wall of the enclosure.

15. The cremated remains spreading device of claim 14 wherein the hopper farther comprises a discharge tube inserted through a sidewall of the conduit forming a constricted cross-section in the conduit, the constricted cross-section causing a turbulence in the pressurized air flow.

* * * * *